US009543689B2

(12) United States Patent
Sato et al.

(10) Patent No.: US 9,543,689 B2
(45) Date of Patent: Jan. 10, 2017

(54) TERMINAL CRIMPED WIRE

(71) Applicant: YAZAKI CORPORATION, Minato-ku, Tokyo (JP)

(72) Inventors: Kei Sato, Shizuoka (JP); Tsutomu Takayama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 60 days.

(21) Appl. No.: 14/496,397

(22) Filed: Sep. 25, 2014

(65) Prior Publication Data

US 2015/0017833 A1 Jan. 15, 2015

Related U.S. Application Data

(63) Continuation of application No. PCT/JP2013/001954, filed on Mar. 22, 2013.

(30) Foreign Application Priority Data

Mar. 30, 2012 (JP) ..... 2012-081796
Jul. 31, 2012 (JP) ..... 2012-169788

(51) Int. Cl.
*H01R 4/20* (2006.01)
*H01R 13/52* (2006.01)
(Continued)

(52) U.S. Cl.
CPC ..... *H01R 13/52* (2013.01); *H01R 4/18* (2013.01); *H01R 4/184* (2013.01); *H01R 4/188* (2013.01);
(Continued)

(58) Field of Classification Search
CPC ..... H01R 13/52; H01R 4/20; H01R 4/18; H01R 4/184; H01R 4/188; H01R 4/62; H01R 13/5213; H01R 13/5216; H01R 13/5221; H01R 13/533; H01R 13/562
(Continued)

(56) References Cited

U.S. PATENT DOCUMENTS 3,573,720 A * 4/1971 Reynolds ..... H01R 13/4362 439/455
5,433,621 A * 7/1995 Sai ..... H01R 13/5205 439/275
(Continued)

FOREIGN PATENT DOCUMENTS

DE 19727314 A1 1/1999
DE 102010009284 A1 8/2011
(Continued)

OTHER PUBLICATIONS

Machine translation of the written description of WO 2011/122302 A1 (published Oct. 6, 2011).*
(Continued)

*Primary Examiner* — Felix O Figueroa
*Assistant Examiner* — Paul Baillargeon
(74) *Attorney, Agent, or Firm* — Mots Law, PLLC

(57) ABSTRACT

A terminal crimped wire includes a wire including a conductor and an insulation sheath covering a circumference of the conductor, a crimping terminal crimped to the wire, an anticorrosion material which covers an exposed part of the wire drawn out of the crimping terminal, and an elastic member provided along a circumference of the wire. The wire is crimped to the crimping terminal via the elastic member interposed therebetween.

19 Claims, 18 Drawing Sheets

(51) Int. Cl.

| | |
|---|---|
| ***H01R 4/18*** | (2006.01) |
| ***H01R 4/62*** | (2006.01) |
| ***H01R 13/533*** | (2006.01) |
| ***H01R 13/56*** | (2006.01) |

(52) U.S. Cl.
CPC ..... *H01R 4/20* (2013.01); *H01R 4/62* (2013.01); *H01R 13/5213* (2013.01); *H01R 13/5216* (2013.01); *H01R 13/5221* (2013.01); *H01R 13/533* (2013.01); *H01R 13/562* (2013.01)

(58) Field of Classification Search
USPC ..... 439/587–588, 730, 741
See application file for complete search history.

(56) References Cited

U.S. PATENT DOCUMENTS

| | | | | |
|---|---|---|---|---|
| 5,564,946 | A | 10/1996 | Kodama | |
| 6,453,551 | B1 * | 9/2002 | Nordquist | H01R 43/005 29/857 |
| 6,709,282 | B2 * | 3/2004 | Sugiyama | H01R 13/5208 439/274 |
| 6,840,804 | B2 * | 1/2005 | Murakami | H01R 13/5205 439/587 |
| 7,048,562 | B2 * | 5/2006 | Lutsch | H01R 4/70 439/275 |
| 2011/0083324 | A1 | 4/2011 | Martauz et al. | |
| 2013/0012077 | A1 | 1/2013 | Sato et al. | |
| 2013/0095708 | A1 | 4/2013 | Mitose et al. | |

FOREIGN PATENT DOCUMENTS

| | | | | |
|---|---|---|---|---|
| JP | H08-306400 | A | 11/1996 | |
| JP | 2002-203636 | A | 7/2002 | |
| JP | 2004-207172 | A | 7/2004 | |
| JP | 3674508 | B2 | 7/2005 | |
| JP | 2007-311369 | A | 11/2007 | |
| JP | 2011-181499 | A | 9/2011 | |
| JP | 2011-210593 | A | 10/2011 | |
| JP | 2011-216253 | A | 10/2011 | |
| WO | 2011115005 | A1 | 9/2011 | |
| WO | 2011118628 | A1 | 9/2011 | |
| WO | 2011122622 | A1 | 10/2011 | |
| WO | 2011125626 | A1 | 10/2011 | |
| WO | WO 2011122302 | A1 * | 10/2011 | H01R 4/20 |
| WO | WO 2011125559 | A1 * | 10/2011 | |

OTHER PUBLICATIONS

Machine translation of the written description of DE 102010009284 A1 (Published Aug. 2011).*
The Japanese office action letter issued on Oct. 13, 2015 in the counterpart Japanese patent application.
The Chinese office action letter issued on Dec. 2, 2015 in the counterpart Chinese patent application.
The Chinese office action issued on Sep. 5, 2016 in the counterpart Chinese patent application.
Official action issued on Nov. 18, 2016 in the counterpart Chinese patent application.

* cited by examiner

TERMINAL CRIMPED WIRE

CROSS REFERENCE TO RELATED APPLICATION

This application is a Continuation of PCT Application No. PCT/JP2013/001954, filed on Mar. 22, 2013, and claims the priority of Japanese Patent Applications No. 2012-081796, filed on Mar. 30, 2012, and No. 2012-169788, filed on Jul. 31, 2012, the content of all of which is incorporated herein by reference.

BACKGROUND

1. Technical Field

The present invention relates to a terminal crimped wire including a wire, a terminal, and an anticorrosion material provided to cover the wire exposed on an outside of the crimping terminal.

2. Related Art

WO 2011/125626 A1 discloses a conventional terminal crimped wire. As illustrated in FIGS. 1 to 3, a conventional terminal crimped wire 150 includes a terminal connection portion 151 to be connected with a mating terminal, a wire connection portion 152 connected to a wire W, and a neck portion 153 connecting the terminal connection portion 151 to the wire connection portion 152. The wire connection portion 152 includes a pair of crimping pieces 152*a*. An exposed part of a conductor 160 of the wire W and a part of an insulation sheath 161 are integrally crimped by the crimping pieces 152*a*. The wire connection portion 152 is provided with a plurality of serrations 152*b* on the inner surface thereof. The area in the wire connection portion 152 where water may be poured to the wire W is covered with solder 155 as an anticorrosion material. In particular, the solder 155 is provided to cover the conductor 160 projecting forward from the crimping pieces 152*a*, and cover a gap provided in a portion where the crimping pieces 52*a* face and come into contact with each other Even when the conventional terminal crimped wire 150 is poured to water, immersion of the conductor 160 in water is prevented in a manner such that the solder 155 prevents pouring water into the conductor 160 from a front and upper sides of the wire connection portion 152, and the serrations 152*b* prevent pouring water into the conductor 160 through a gap between the back end of the wire connection portion 152 and the insulation sheath 161 of the wire W. In the case where the conductor 160 is made of aluminum, galvanic corrosion can be prevented. Namely, a water cut-off performance and an anticorrosion property of the terminal crimped wire 150 are improved due to the solder 155 and the serrations 152*b*.

SUMMARY

However, the sealing performance of the terminal crimped wire 150 is decreased in the state where the wire W extending from the crimping terminal is bent. As a result, the water cut-off performance and the anticorrosion property are decreased. That is, when the wire W is bent, a gap may be caused between the wire W and the wire connection portion 152 on the outside of the bent portion of the wire W, and the gap causes pouring water into the conductor 160 of the wire W.

The present invention has been made in view of the above-described problem. It is an object of the present invention to provide a terminal crimped wire capable of improving a sealing performance in a state where a wire extending from the crimping terminal is bent.

A terminal crimped wire according to a first aspect of the present invention includes: a wire including a conductor and an insulation sheath covering a circumference of the conductor, a crimping terminal crimped to the wire, an anticorrosion material which covers an exposed part of the wire drawn out of the crimping terminal, and an elastic member provided along a circumference of the wire. The crimping terminal is crimped to the wire via the elastic member interposed therebetween.

Serrations may be provided on the inner surface of the crimping terminal.

The conductor may be made of aluminum or an aluminum alloy. The crimping terminal may be crimped to the conductor exposed in a manner such that the insulation sheath at a terminal of the wire is removed, and an end portion of the insulation sheath. The elastic member may include a cylindrical elastic sealing member which covers the circumference of the end portion of the insulation sheath towards the exposed conductor and the circumference of the exposed conductor adjacent to the end portion of the insulation sheath. The crimping terminal may include a conductor crimping portion by which the exposed conductor is crimped, and an elastic member crimping portion located in the end portion of the crimping terminal on the wire connection side to crimp a part of the elastic member where the circumference of the exposed conductor is covered. A gap in the crimping terminal crimping the wire may be covered with the anticorrosion material.

The crimping terminal may include a pair of crimping pieces integrally crimped to the exposed conductor and the insulation sheath. The anticorrosion material may be solder. The solder may cover the outer surface of the conductor drawn out of the crimping pieces and a gap in the crimping pieces.

The part of the elastic member covering the circumference of the exposed conductor may have a length in the extending direction of the wire which is set in a manner such that the part of the elastic member can fit in a terminal housing portion of a connector housing.

Lip portions may be provided on and project from an inner surface of the elastic member in a corrugated pattern in cross section so as to decrease an inner diameter of the elastic member.

A groove may be provided on the inner surface of the elastic member crimping portion in the direction perpendicular to the extending direction of the wire.

The anticorrosion material may be applied in a manner as to be distant from the insulation sheath in the extending direction of the wire.

The elastic member crimping portion may be integrated with the conductor crimping portion in the extending direction of the wire without interposing a gap therebetween.

In accordance with the terminal crimped wire according to the first aspect of the present invention, since the elastic member is interposed between the wire and the crimping terminal, a gap through which water can pour is not easily caused between the wire and the crimping terminal on the outside of the bent portion of the wire in the case where the wire extending from the crimping terminal is bent. Therefore, it is possible to improve a sealing performance in the state where the wire extending from the crimping terminal is bent, and thereby to improve a water cut-off performance and an anticorrosion property.

DETAILED DESCRIPTION

Hereinafter, embodiments of the present invention will be explained with reference to the drawings.

First Embodiment

Figure 1:
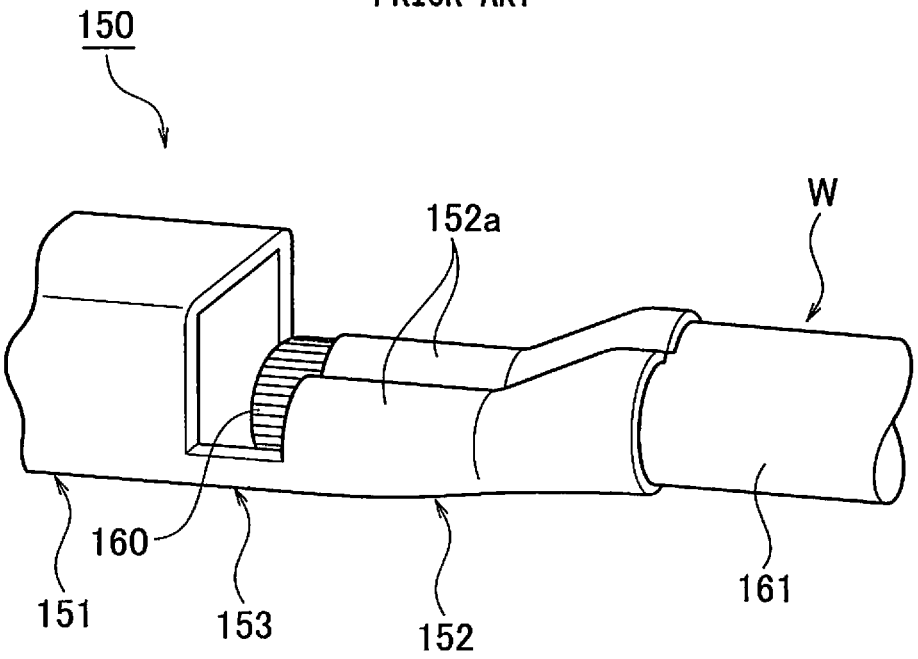
FIG. 1 PRIOR ART
FIG. 1 is a perspective view of a main part of a terminal crimped wire according to a conventional example before solder is applied thereto.
Figure 2:
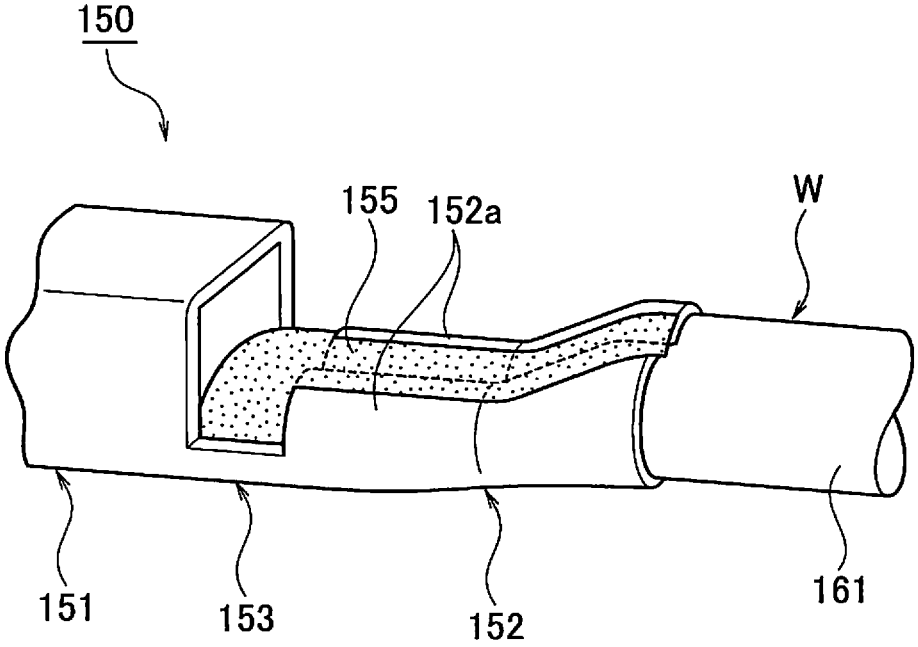
FIG. 2 PRIOR ART
FIG. 2 is a perspective view of the main part of the connection terminal according to the conventional example.
Figure 3:
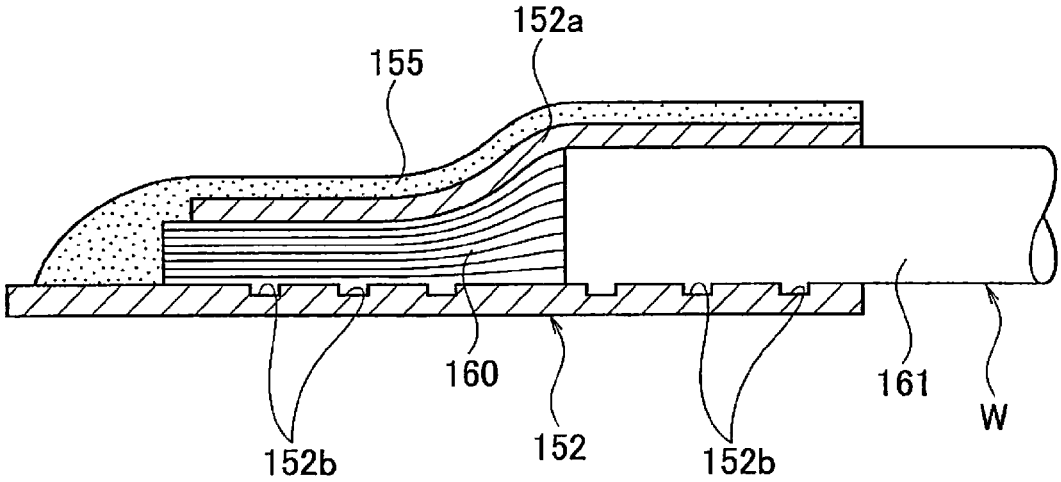
FIG. 3 PRIOR ART
FIG. 3 is a cross sectional view of the main part of the connection terminal according to the conventional example.
Figure 4:
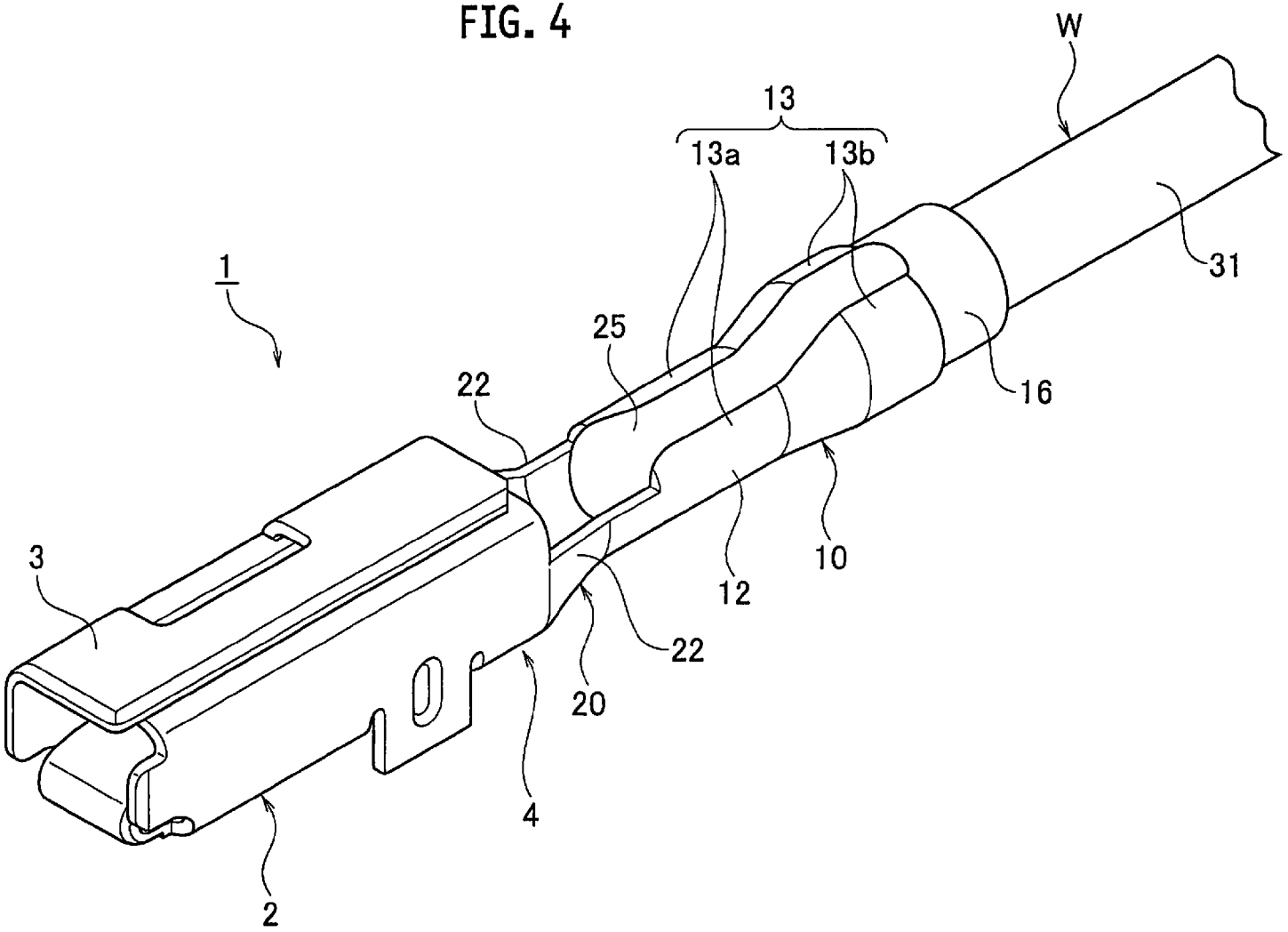
FIG. 4 is a perspective view of a terminal crimped wire according to a first embodiment.
Figure 5A:
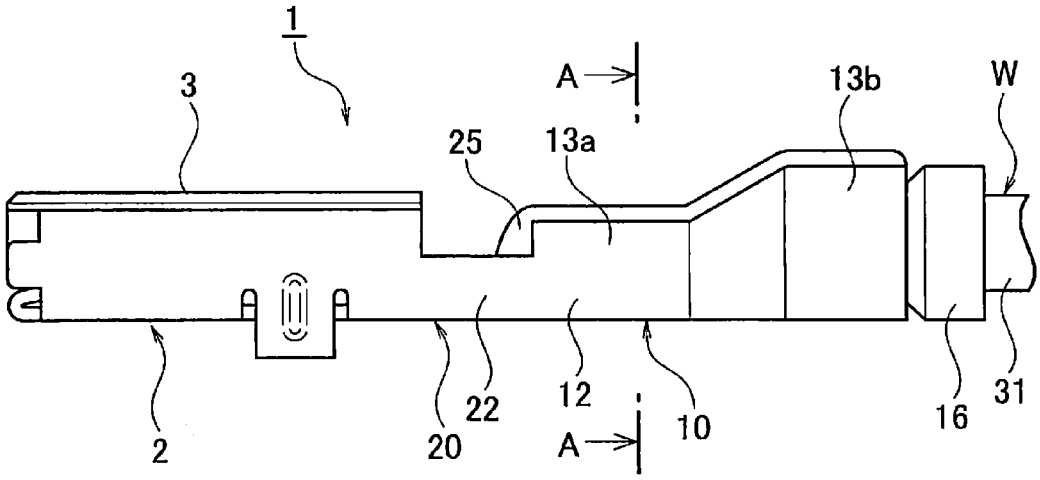
FIG. 5A is a side view of the terminal crimped wire according to the first embodiment.
Figure 5B:
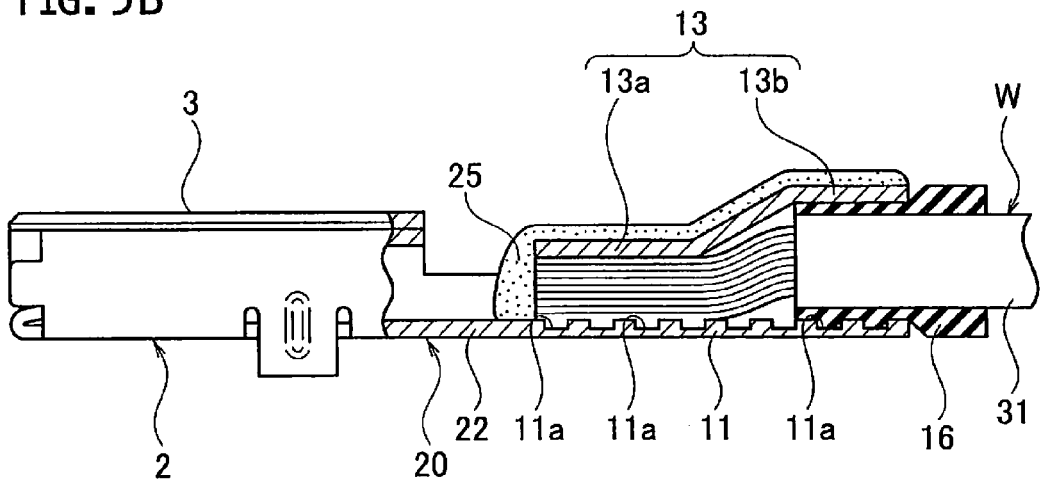
FIG. 5B is a partially exploded cross sectional view of FIG. 5A.

As illustrated in FIGS. 4 and 5, a terminal crimped wire 1 according to a first embodiment includes a wire W including a conductor 30 made of aluminum or aluminum alloy and an insulation sheath 31 covering the circumference of the conductor 30, and a crimping terminal 4 crimped to the wire W. The crimping terminal 4 includes a terminal connection portion 2 to be connected with a mating terminal (not illustrated), a wire connection portion 10 crimped to the wire W, and a neck portion 20 connecting the terminal connection portion 2 to the wire connection portion 10. The terminal connection portion 2, the wire connection portion 10, and the neck portion 20 are formed in a manner such that a conductive metal plate made of a copper alloy having a predetermined shape is bent.

The terminal connection portion 2 includes a square cylindrical portion 3, and an elastic contact piece (not illustrated) disposed inside the cylindrical portion 3. When the mating terminal is inserted into the cylindrical portion 3, the mating terminal comes into close contact with the cylindrical portion 3 by an elastic restoring force of the elastic contact piece. As a result, the mating terminal is electrically connected to the terminal connection portion 2.

The wire connection portion 10 includes a wire connection portion bottom wall 11, a pair of wire connection portion side walls 12 extending from both side edges of the wire connection portion bottom wall 11, and a pair of crimping pieces 13 further extending from the respective wire connection portion side walls 12. A plurality of serrations 11*a* are provided on inner surfaces of the wire connection portion bottom wall 11 and the wire connection portion side walls 12. Each of the serrations 11*a* extends in a direction perpendicular to the axis direction of the wire W.

Each of the crimping pieces 13 includes a conductor crimping portion 13*a* located towards a front side, and a sheath crimping portion 13*b* connected to the conductor crimping portion 13*a* and located towards a rear side. In each of the crimping pieces 13, an extending height of the sheath crimping portion 13*b* is higher than that of the conductor crimping portion 13*a*. In the pair of the crimping pieces 13, the conductor crimping portions 13*a* are crimped to the conductor 30, and the sheath crimping portions 13*b* are crimped to the insulation sheath 31 while interposing an elastic member 16 between the sheath crimping portions 13*b* and the insulation sheath 31. Namely, the conductor 30 and the insulation sheath 31 are integrally crimped by the crimping pieces 13.

The elastic member 16 is deformed by a compression force applied from the crimping pieces 13 and the insulation sheath 31. The elastic member 16 is formed into a cylindrical shape made of, for example, silicone rubber, and is preliminarily fitted to the circumference of the insulation sheath 31 before crimping.

Figure 5C:
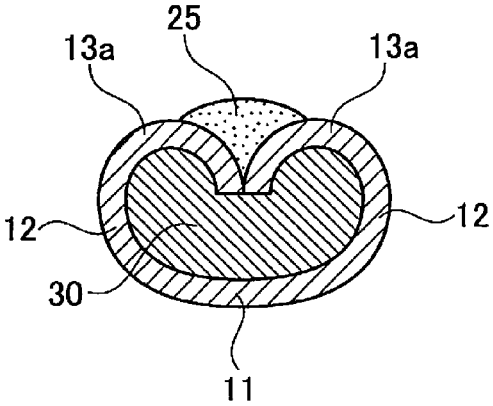
FIG. 5C is a cross sectional view along the line A-A in FIG. 5A.
Figure 6:
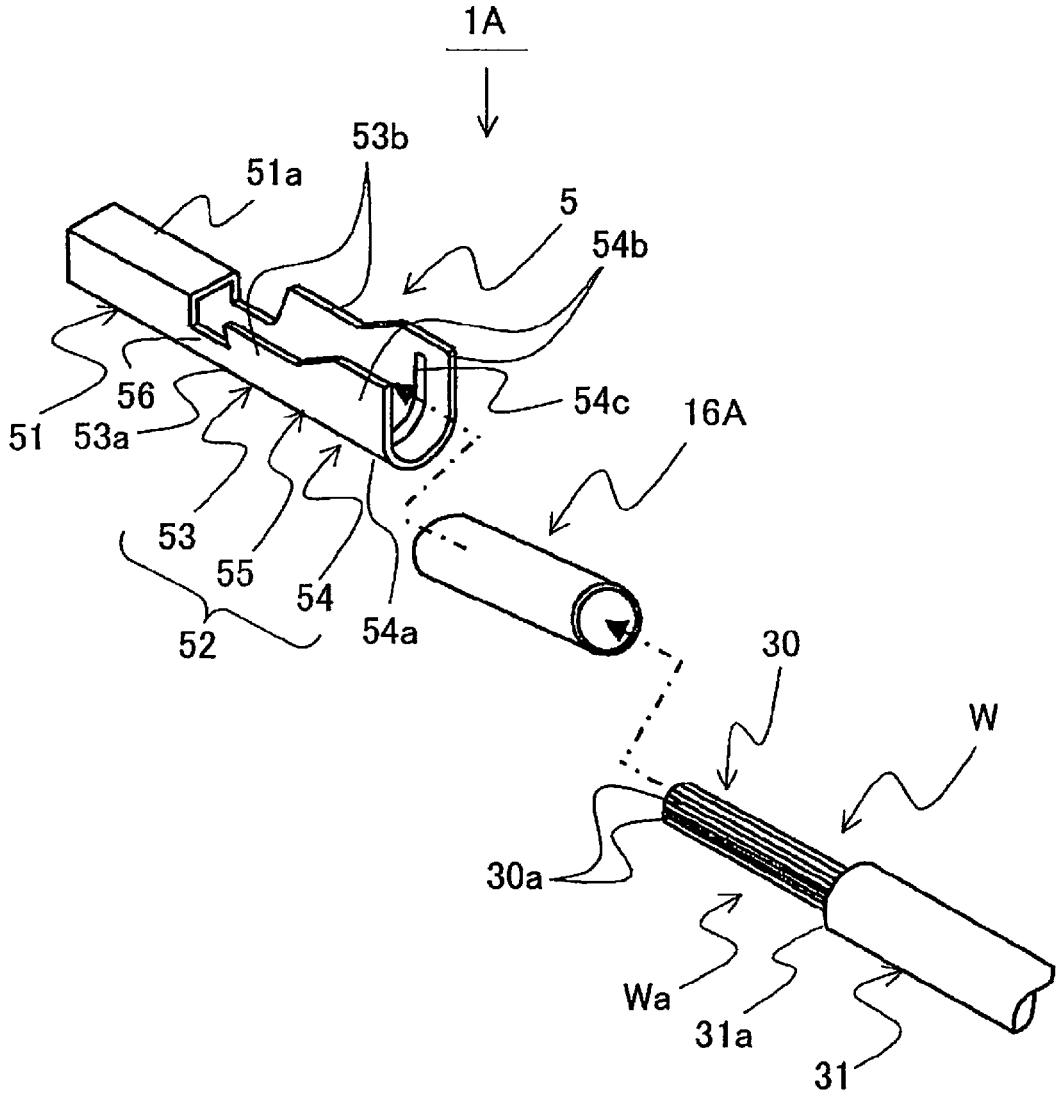
FIG. 6 is an exploded perspective view of a terminal crimped wire according to a second embodiment.
Figure 7:
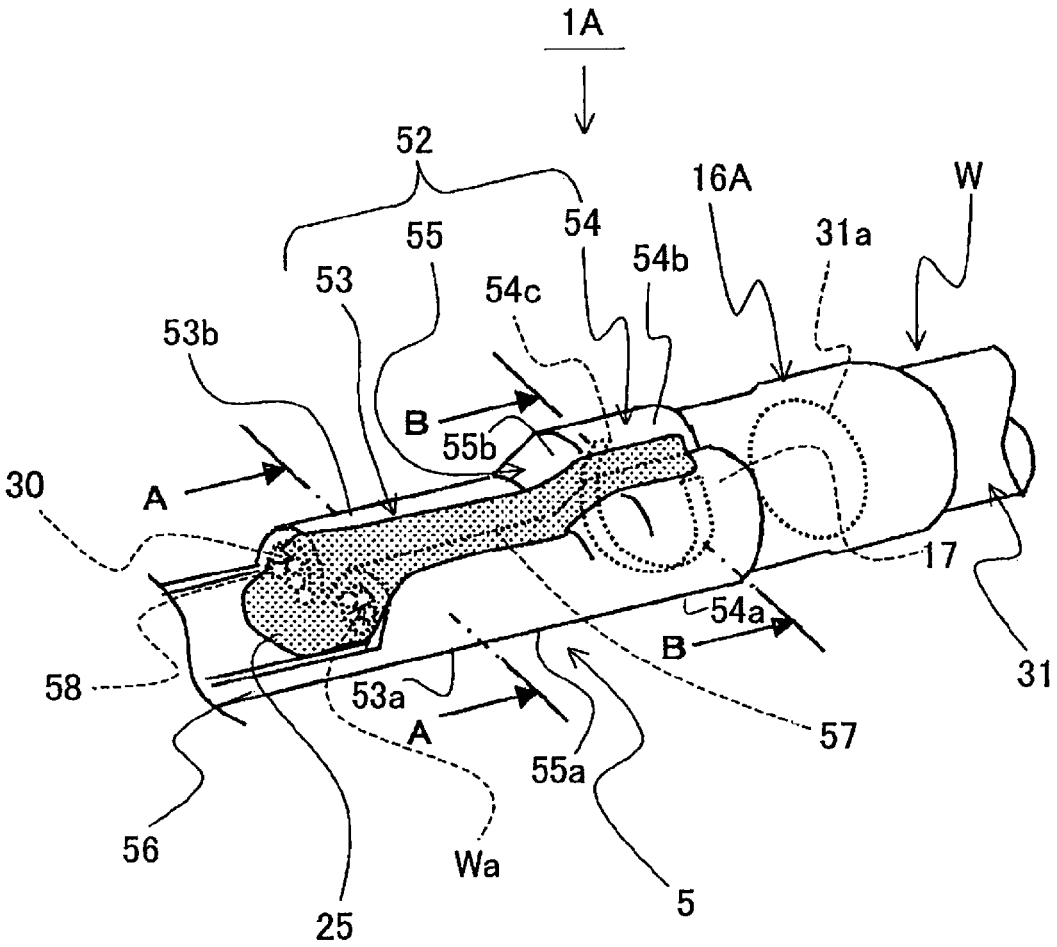
FIG. 7 is an enlarged view around a wire connection portion of the crimping portion in the terminal crimped wire illustrated in FIG. 6.

The crimping pieces 13 are crimped in a manner such that the respective edges come into contact with each other (see FIG. 5C).

The neck portion 20 includes a neck portion bottom wall 21, and a pair of neck portion side walls 22 elongated upward from both edges of the neck portion bottom wall 21. The neck portion bottom wall 21 and the neck portion side walls 22 are integrated with each wall of the terminal connection portion 2 and each wall of the wire connection portion 10, respectively.

An area in the wire connection portion 10 where water maybe poured the wire W, is covered with solder 25 as an anticorrosion material. In particular, the solder 25 is provided to cover the conductor 30 exposed on the outside of the pair of the crimping pieces 13, and cover a gap between the pair of the crimping pieces 13. The solder 25 is provided in a manner such that the solder in a molten state is applied by use of a soldering iron, or soldering paste is applied and then heated.

The elastic member 16 is interposed between the crimping pieces 13 and the insulation sheath 31. Therefore, even when the wire W extending from the wire connection portion 10 is bent, a gap through which water can be poured is not easily caused between the wire connection portion 10 and the insulation sheath 31. In particular, the elastic member 16 on the outside of the bent portion of the wire W is deformed in an elastic restoring direction to fill a gap caused between the wire connection portion 10 and the insulation sheath 31. Therefore, a sealing performance in the state where the wire extending from the wire connection portion 10 is bent, can be improved. In the terminal crimped wire 1 according to the present embodiment, an anticorrosion property can be improved since the conductor 30 is made of aluminum or an aluminum alloy. Further, a water cut-off performance can be improved in the case where the conductor 30 is made of copper.

Installing the elastic member 16 to the circumference of the wire W can be automatically processed by a machine. Therefore, the water cut-off performance between the wire connecting portion 10 and the wire W can be improved without debasement of processing performance.

The serrations 11*a* are provided on the inner surface of the wire connection portion 10. Therefore, the sealing performance between the wire connection portion 10 and the wire W can be further improved. In addition, a fixing capacity of the wire W can also be improved.

Modified Example

Although the terminal crimped wire 1 according to the first embodiment is provided with the serrations 11*a* on the inner surface of the wire connection portion 10, the serrations 11*a* are not necessarily provided.

Although the solder 25 is used as the anticorrosion material in the terminal crimped wire 1 according to the first embodiment, grease, a hot-melt adhesive, or the like may be used as the anticorrosion material.

Although the conductor 30 in the terminal crimped wire 1 according to the first embodiment is made of aluminum or an aluminum alloy, the conductor 30 may be made of copper or the like.

Second Embodiment

As illustrated in FIGS. 6 to 11, a terminal crimped wire 1A according to a second embodiment includes a wire W including a conductor 30 made of aluminum or an aluminum alloy and an insulation sheath 31 covering the circumference of the conductor 30, a cylindrical elastic member 16A for covering the circumference of an end portion 31*a* of the insulation sheath 31 where the conductor 30 is exposed from the insulation sheath 31 and the circumference of the exposed conductor 30 adjacent to the end portion 31*a*, and a crimping terminal 5 crimped to the exposed conductor 30 exposed by the removal of the insulation sheath 31 at a terminal portion Wa of the wire W. A joint 57 and an opening 58 of the crimping terminal 5 crimped to the wire W are sealed with a sealing material 25 as a anticorrosion material.

The conductor 30 is formed by stranding a plurality of strands 30*a* made of aluminum or an aluminum alloy. The insulation sheath 31 is made of insulating synthetic resin, and covers the circumference of the conductor 30 so that the conductor 30 is externally insulated. The conductor 30 may be a single core wire made of aluminum or an aluminum alloy.

The elastic member 16A is made of an elastic material such as silicone rubber, and the inner diameter of the cylindrical shape thereof is slightly smaller than the diameter of the conductor 30. Therefore, the elastic member 16A comes into close contact with the circumference of the insulation sheath 31 and the circumference of the exposed conductor 30.

The inner diameter of the elastic member 16A can be set to be slightly smaller than the diameter of the insulation sheath 31 by use of, for example, a heat-shrinkable elastic material. In this case, the elastic member 16A is placed in a predetermined position on the wire W, and then heated, so that the elastic member 16A is brought into close contact with the wire W.

The crimping terminal 5 is formed in a manner such that a flat plate made of metal such as copper or a copper alloy is bent by press working. The crimping terminal 5 includes a terminal connection portion 51 to be connected with a mating terminal (not illustrated), a crimping piece 52 connected to the wire W, a neck portion 56 connecting the terminal connection portion 51 to the crimping piece 52.

The terminal connection portion 51 includes a square cylindrical portion 51*a*, and an elastic contact piece portion (not illustrated) disposed inside the cylindrical portion 51*a*. When the mating terminal is inserted into the cylindrical portion 51*a*, the mating terminal comes into close contact with the cylindrical portion 51*a* by an elastic restoring force of the elastic contact piece. As a result, the mating terminal is electrically connected to the terminal connection portion 51.

The crimping piece 52 includes a conductor crimping portion 53 crimped to the exposed conductor 30, an elastic member crimping portion 54 located in the end portion of the crimping terminal 5 on the wire W side to crimp a part 17 (hereinafter, referred to as sealing portion 17) of the elastic member 16A which covers the circumference of the exposed conductor 30, and a connection portion 55 integrally connecting the conductor crimping portion 53 to the elastic member crimping portion 54.

Figure 10:
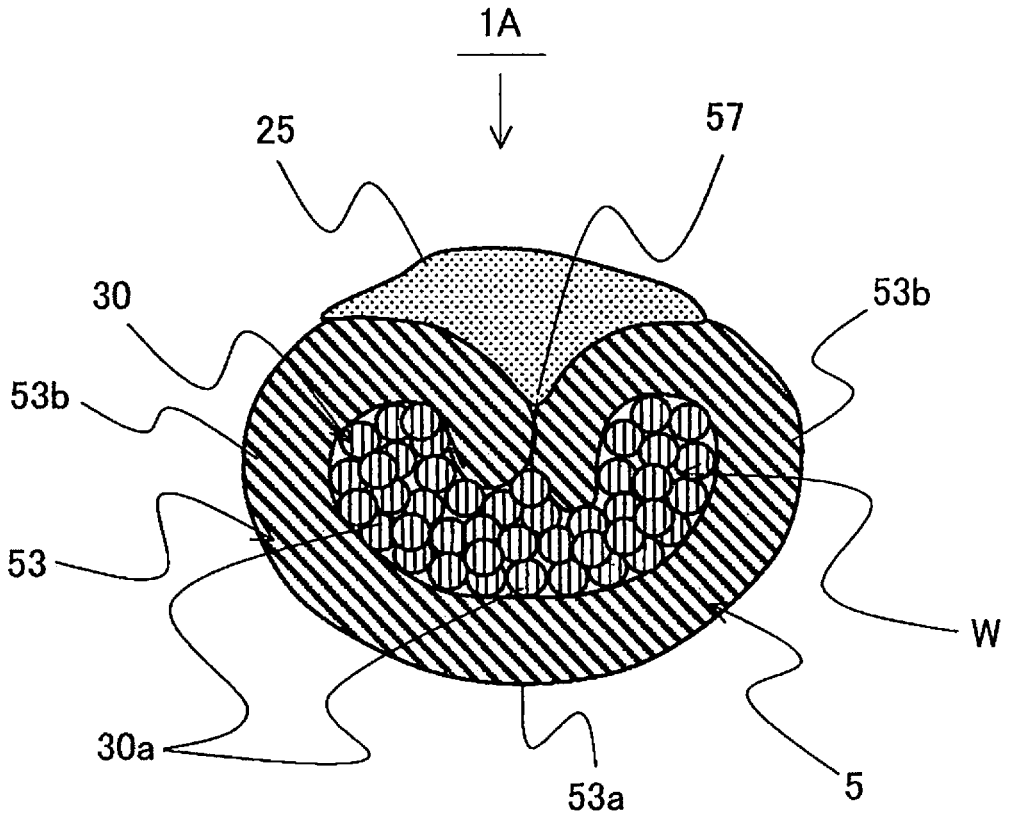
FIG. 10 is a cross sectional view along the line A-A in FIG. 7.

The conductor crimping portion 53 includes a conductor crimping portion bottom wall 53*a* on which the conductor 30 is placed, and a pair of conductor crimping portion side walls 53*b* elongated upward from both edges of the conductor crimping portion bottom wall 53*a* and crimped in a manner as to cover the conductor 30 from both sides to the upper side of the conductor 30. As illustrated in FIG. 10, the height of the respective conductor crimping portion side walls 53*b* is set in a manner such that upper edge portions of the pair of the conductor crimping portion side walls 53*b* come into contact with each other so as to cover the circumference of the conductor 30. In other words, the height of the respective conductor crimping portion side walls 53*b* is set according to the diameter of the conductor 30.

The elastic member crimping portion 54 is integrated with the conductor crimping portion 53 along the extending direction of the wire W without providing a gap therebetween, and is located in the end portion of the crimping terminal 5 to which the wire W is connected.

In particular, the elastic member crimping portion 54 includes an elastic member crimping portion bottom wall 54*a* on which the sealing portion 17 is placed, and a pair of elastic member crimping portion side walls 54*b* crimped in a manner as to cover the sealing portion 17 from both sides to the upper side of the sealing portion 17. The height of the respective elastic member crimping portion side walls 54*b* is set in a manner such that upper edge portions of the pair of the elastic member crimping portion side walls 54*b* come into contact with each other so as to cover the circumference of the sealing portion 17.

Namely, the height of the respective elastic member crimping portion side walls 54*b* is set according to the diameter of the sealing portion 17. The diameter of the sealing portion 17 is larger than that of the conductor 30 by the thickness of the elastic member 16A. Therefore, the height of the respective elastic member crimping portion side walls 54*b* is set to be higher than that of the respective conductor crimping portion side walls 53*b*.

Figure 11:
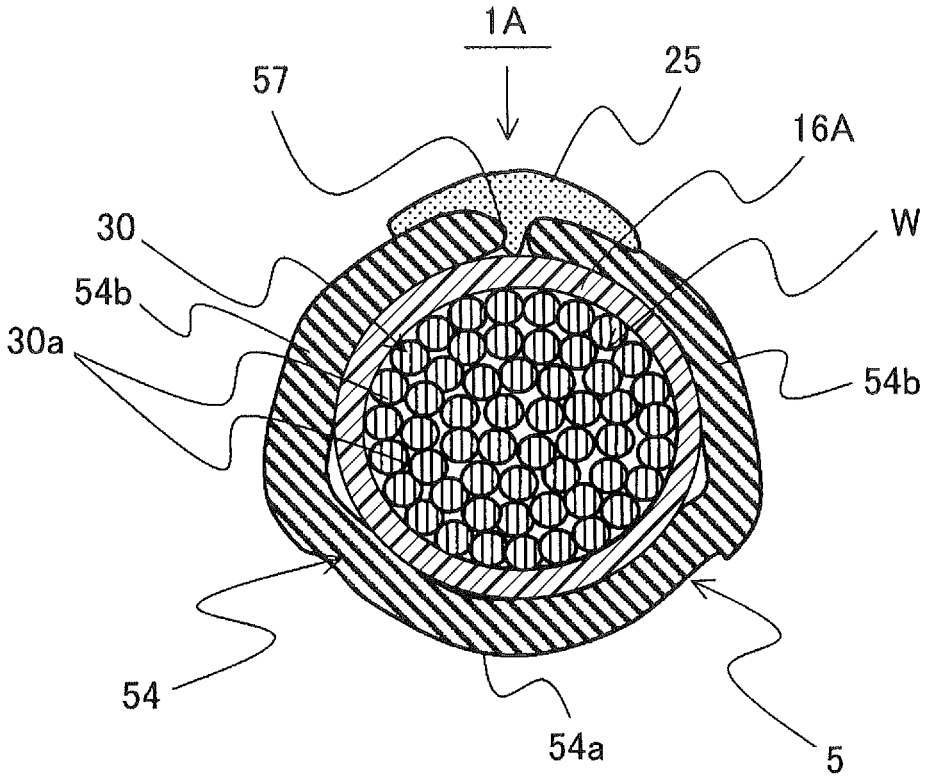
FIG. 11 is a cross sectional view along the line B-B in FIG. 7.

As illustrated in FIG. 11, the sealing portion 17 is crimped by the elastic member crimping portion 54 in a manner such that a deformation level of the elastic member crimping portion 54 at the point of crimping is smaller than that of the conductor crimping portion 53. This is because an excessive compression force is not applied to the elastic member 16A in order to effectively utilize the elastic force of the elastic member 16A to obtain a water sealing effect.

A groove 54*c* is provided on the inner surface of the elastic member crimping portion 54 in the direction perpendicular to the extending direction of the wire W. At the point of crimping the sealing portion 17 by the elastic member crimping portion 54, the elastic member 16A is deformed to enter the groove 54*c*. The groove 54*c* thus prevents the wire W from being removed from the crimping terminal 5 by a tensile force in the extending direction of the wire W.

Figure 8:
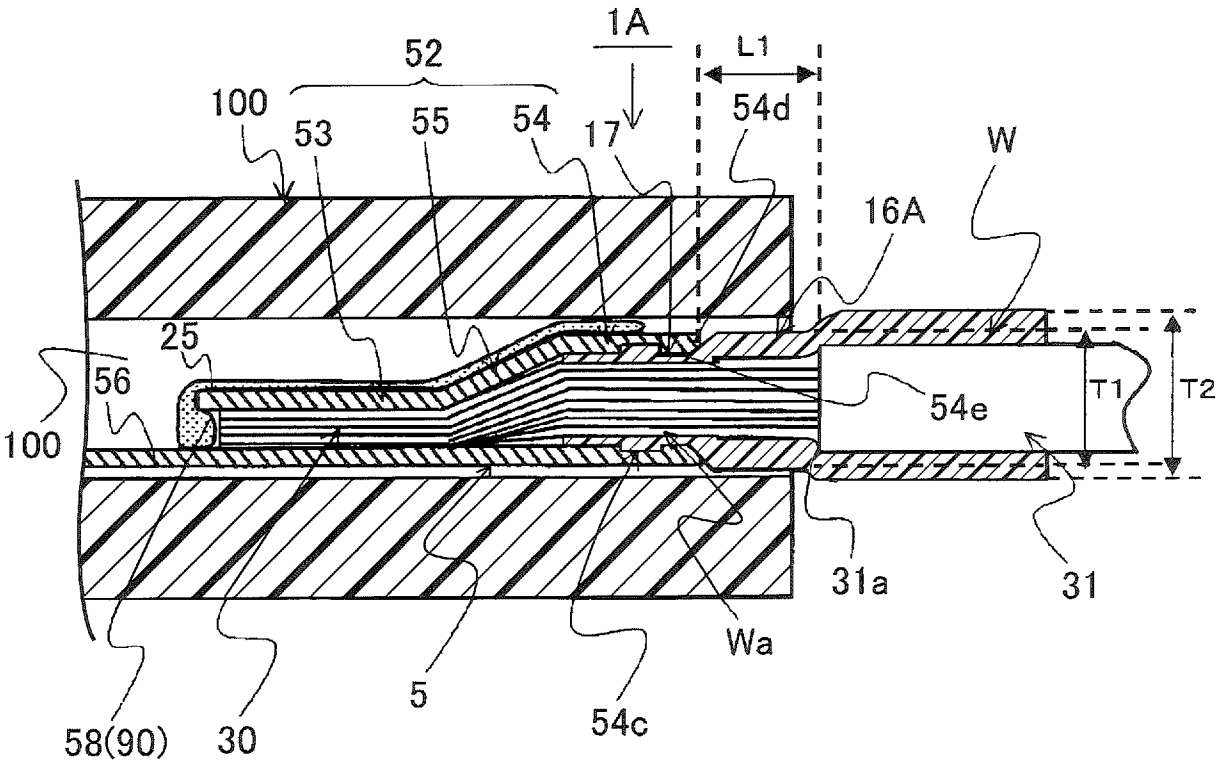
FIG. 8 is a cross sectional side view of the terminal crimped wire illustrated in FIG. 6, and is a view to which a cross section of a connector housing equipped with the terminal crimped wire is added.
Figure 9:
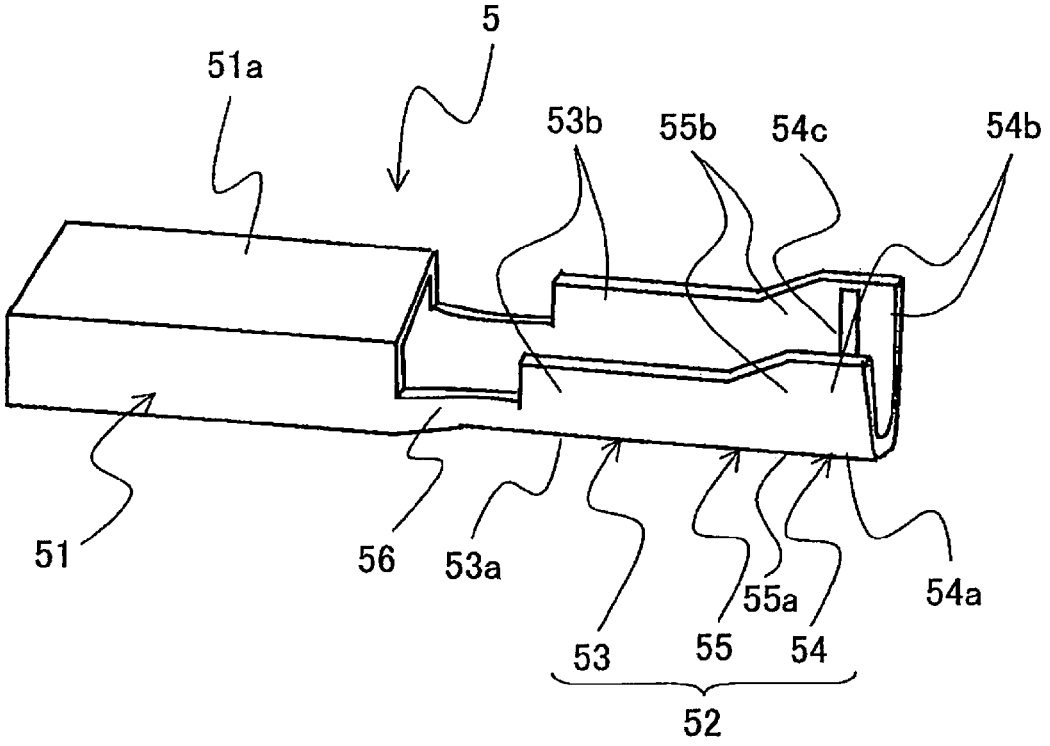
FIG. 9 is an enlarged perspective view of the crimping terminal illustrated in FIG. 6.

As illustrated in FIG. 8, the elastic member crimping portion 54 is provided, on the inner surface thereof, with a tapered surface 54*e* inclined in a manner such that the thickness of the crimping terminal 5 is decreased towards a rear edge surface 54*d* from slightly inside the rear edge surfaces 54*d*. The elastic member 16A is deformed along the tapered surface 54*e*, so that the gap between the crimping terminal 5 and the conductor 30 in the elastic member crimping portion 54 on the rear edge surface 54*d* side, can surely be sealed with the elastic member 16A, and water is thus prevented from pouring therethrough.

The length of the sealing portion 17 in the extending direction of the wire W is set in a manner such that the sealing portion 17 can fit in a terminal housing portion 110 of a connector housing 100 in which the terminal crimped wire 1A is housed. In particular, as illustrated in FIG. 8, a length L1 in the sealing portion 17 from the rear edge of the crimping terminal 5 to the front edge of the insulation sheath 31, is set according to the dimension of the terminal housing portion 110. That is, compared with a width T2 in the diametrical direction of the portion where the insulation sheath 31 is provided, a width T1 in the diametrical direction in the part of the length L1 in the terminal crimped wire 1A, is reduced as much as possible so that the terminal housing portion 110 is not required to have a large size. Accordingly, the terminal crimped wire 1A can be housed in the terminal housing portion 110 of the connector housing 100 with any dimension.

The connection portion 55 includes a connection portion bottom wall 55*a* integrated with the conductor crimping portion bottom wall 53*a* at the front edge and integrated with the elastic member crimping portion bottom wall 54*a* at the rear edge, respectively, and a pair of connection portion side walls 55*b* integrated with the pair of the conductor crimping portion side walls 53*b* at front edges, and integrated with the pair of the elastic member crimping portion side walls 54*b* at rear edges, respectively. Each of the connection portion side walls 55*b* is connected to the conductor crimping portion side wall 53*b* and the elastic member crimping portion side wall 54*b* at the front and rear edges, respectively, which are different in height. Therefore, the upper edge surface of each connection portion side wall 55*b* is inclined upward from the front edge to the rear edge.

When the wire W is crimped by the crimping terminal 5, the joint 57, which is a gap 90 in the crimping terminal 5, and the opening 58 are sealed with the sealing material 25 such as solder. The sealing material 25 is applied in a manner as to be distant from the insulation sheath 31. Due to the space provided between the insulation sheath 31 and the sealing material 25, a thermal influence on the insulation sheath 31 is reduced at the point of applying the sealing material 25.

The sealing material 25 is not limited to solder, and may be synthetic resin such as ultraviolet curable resin, or the like. However, a conductive material is preferably used for the sealing material 25 in view of preventing an increase in resistance as much as possible.

A conventional crimping terminal having a similar shape to the crimping terminal 5 may be used, in which the insulation sheath 31 is crimped by a portion corresponding to the elastic member crimping portions 54. In this case, the insulation sheath 31 is removed in a manner such that the exposed length of the conductor 30 at a terminal portion Wa of the wire W is set to be longer than that in a conventional wire crimped by the conventional crimping terminal, so that the insulation sheath 31 is not crimped by the crimping terminal 5.

Next, a procedure of assembling the wire W and the crimping terminal 5 in the terminal crimped wire 1A according to the second embodiment is explained below with reference to FIGS. 12A to 12E.

Figure 12A:
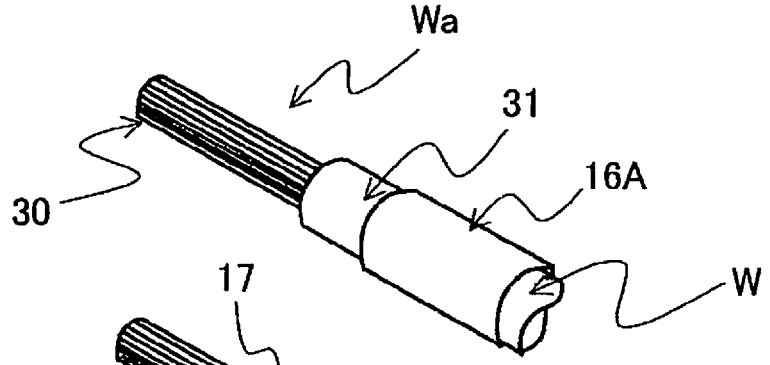
FIGS. 12A to 12E are views illustrating a procedure of assembling the wire and the crimping terminal in the terminal crimped wire according to the second embodiment.

First, an operator inserts the wire W into the elastic member 16A, and removes the insulation sheath 31 of the terminal portion Wa of the wire W (see FIG. 12A).

Figure 12B:
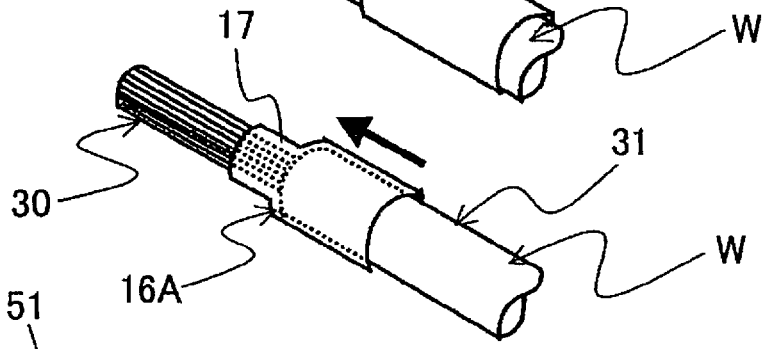

Then, the operator moves the elastic member 16A to cover the circumference of the end portion 31*a* of the insulation sheath 31 on the exposed conductor 30 side and the circumference of the exposed conductor 30 adjacent to the end portion 31*a* (see FIG. 12B).

Figure 12C:
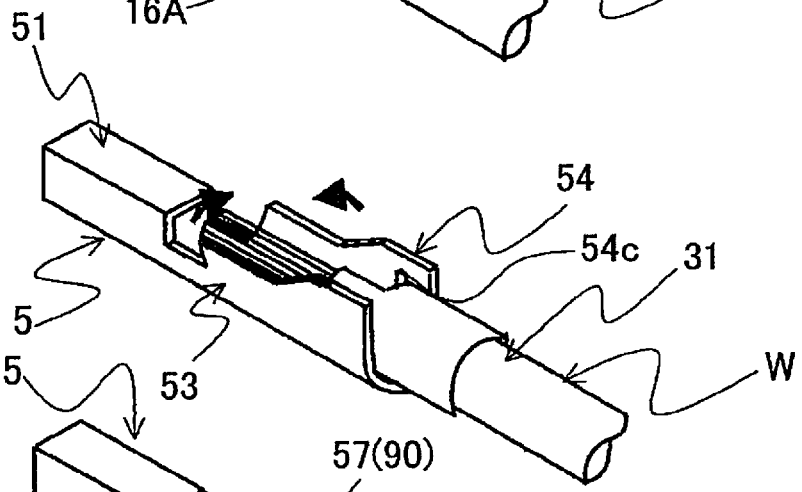
Figure 12D:
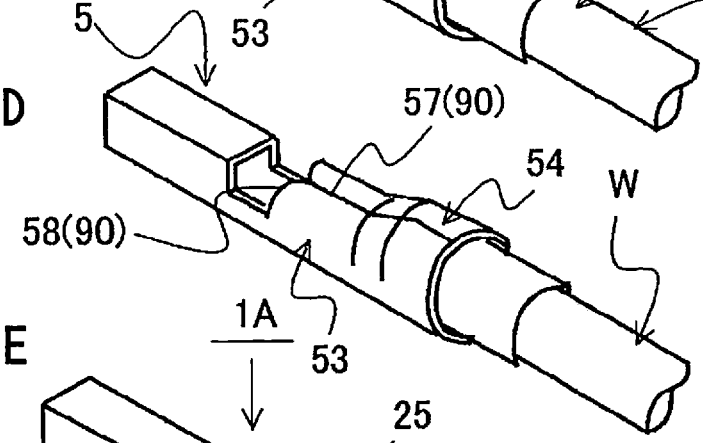

Then, the operator crimps the crimping terminal 5 to crimp the wire W (see FIGS. 12C and 12D). Here, the wire W is crimped by the crimping terminal 5 by use of a metal mold (not illustrated) or the like. Thus, the conductor crimping portion 53 is crimped to the exposed conductor 30, and the elastic member crimping portion 54 is crimped to the sealing portion 17. The conductor crimping portion 53 and the elastic member crimping portion 54 are integrated with each other in the extending direction of the wire W while interposing the connection portion 55 therebetween. Therefore, the crimping terminal 5 is crimped in a manner such that the joint 57 is provided along the extending direction of the wire W.

Figure 12E:
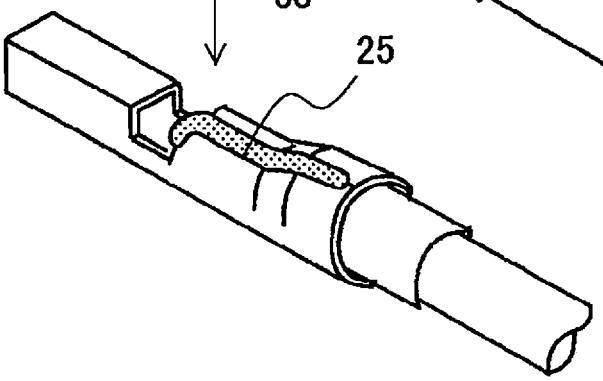

Thereafter, the operator seals the joint 57 of the crimping terminal 5 and the opening 58 with the sealing material 25, thereby completing the procedure of assembling the wire W and the crimping terminal 5 (see FIG. 12E). Here, the sealing material 25 is applied in a manner as to be distant from the insulation sheath 31.

The terminal crimped wire 1A according to the second embodiment obtains a water cut-off performance in a manner such that the exposed conductor 30 and the end portion 31*a* of the insulation sheath 31 adjacent to the conductor 30, are covered with and brought into close contact with the elastic member 16A, and such that the joint 57, which is the gap 90 of the crimping terminal 5, and the opening 58 are sealed with the sealing material 25. In addition, the conductor crimping portion 53 is crimped to the exposed conductor 30, so that the crimping terminal 5 is connected to the conductor 30 without increasing resistance. Further, not a part of the elastic member 16A where the insulation sheath 31 is covered but a part of the elastic member 16A where the exposed conductor 30 is directly covered, is crimped by the crimping terminal 5. Therefore, an increase in width of the terminal crimped wire 1A in the diametrical direction is prevented. Thus, the terminal housing portion 110 of the connector housing 100 in which the terminal crimped wire 1A is housed, is not required to have a large size. Accordingly, the conductor 30 can be tightly covered with the crimping terminal 5 in a watertight manner without increasing resistance, which expands versatility.

The part of the terminal crimped wire 1A according to the second embodiment where the insulation sheath 31 is removed, is housed in the connector housing 100. Therefore, the width in the diametrical direction of the terminal crimped wire 1A can be minimized, and the terminal housing portion 110 is thus not required to have a large size. As a result, versatility can be expanded.

In the terminal crimped wire 1A according to the second embodiment, the elastic member 16A is deformed at the point of crimping by the elastic member crimping portion 54, and the elastic member 16A thus enters the groove 54*c*. Accordingly, the wire W is prevented from being removed from the crimping terminal 5 by a tensile force in the extending direction of the wire W.

In the terminal crimped wire 1A according to the second embodiment, the sealing material 25 is applied in a manner as to be distant from the insulation sheath 31. Therefore, a thermal influence on the insulation sheath 31 is reduced at the point of applying the sealing material 25.

In the terminal crimped wire 1A according to the second embodiment, the elastic member crimping portion 54 is integrated with the conductor crimping portion 53 with no gap in the extending direction of the wire W. Therefore, the water cut-off performance of the crimping terminal 5 can be improved.

Modified Example 1

A terminal crimped wire 1B according to a modified example 1 of the second embodiment is explained below with reference to FIGS. 13 and 14.

Figure 13:
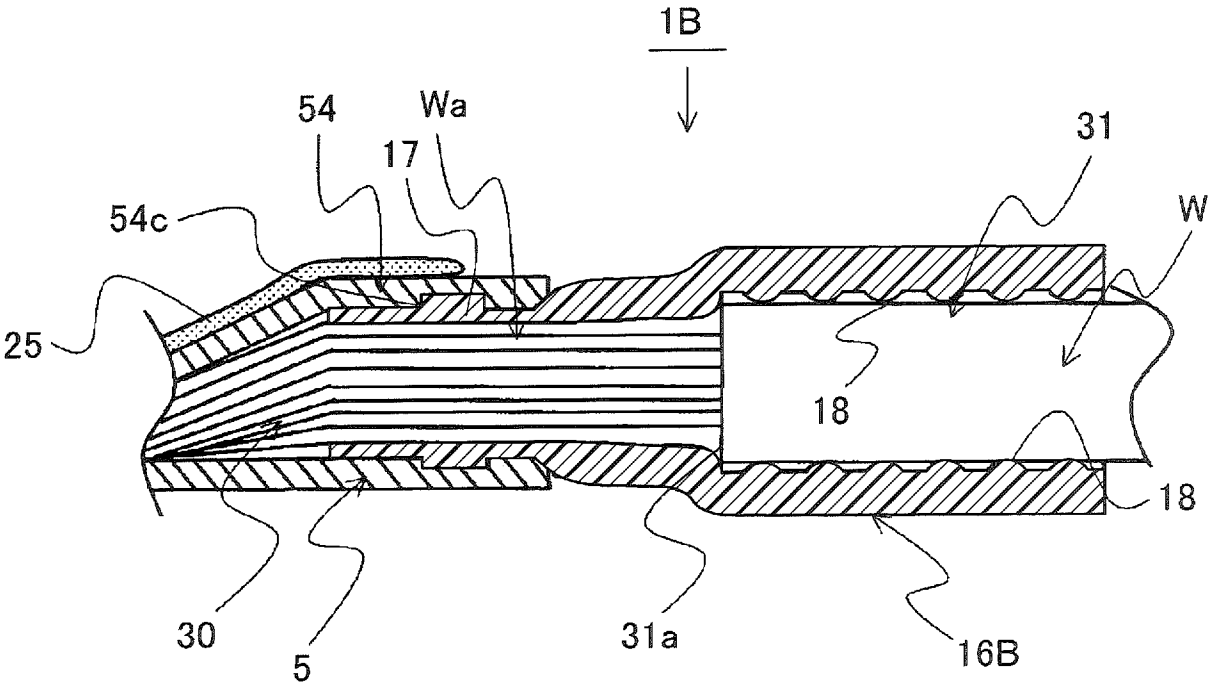
FIG. 13 is a cross sectional side view of a terminal crimped wire according to a modified example 1 of the second embodiment.

As illustrated in FIG. 13, the terminal crimped wire 1B according to the modified example 1 is different from the terminal crimped wire 1A of the second embodiment in that an elastic member 16B is provided instead of the elastic member 16A. Other components are the same as the second embodiment, and the same components are indicated by the same reference numerals as the second embodiment.

A plurality of lip portions 18 are provided on and project from the inner surface of the elastic member 16B in a corrugated pattern in cross section so as to decrease the inner diameter of the elastic member 16B. Due to the provision of the lip portions 18, it is possible to surely prevent water from pouring into the elastic member 16B through the back end of the elastic member 16B.

The terminal crimped wire 1B according to the modified example 1 can obtain the same effects as the terminal crimped wire 1A according to the second embodiment. In addition, since it is possible to surely prevent water from pouring into the elastic member 16B, the water cut-off performance can be improved.

Figure 14:
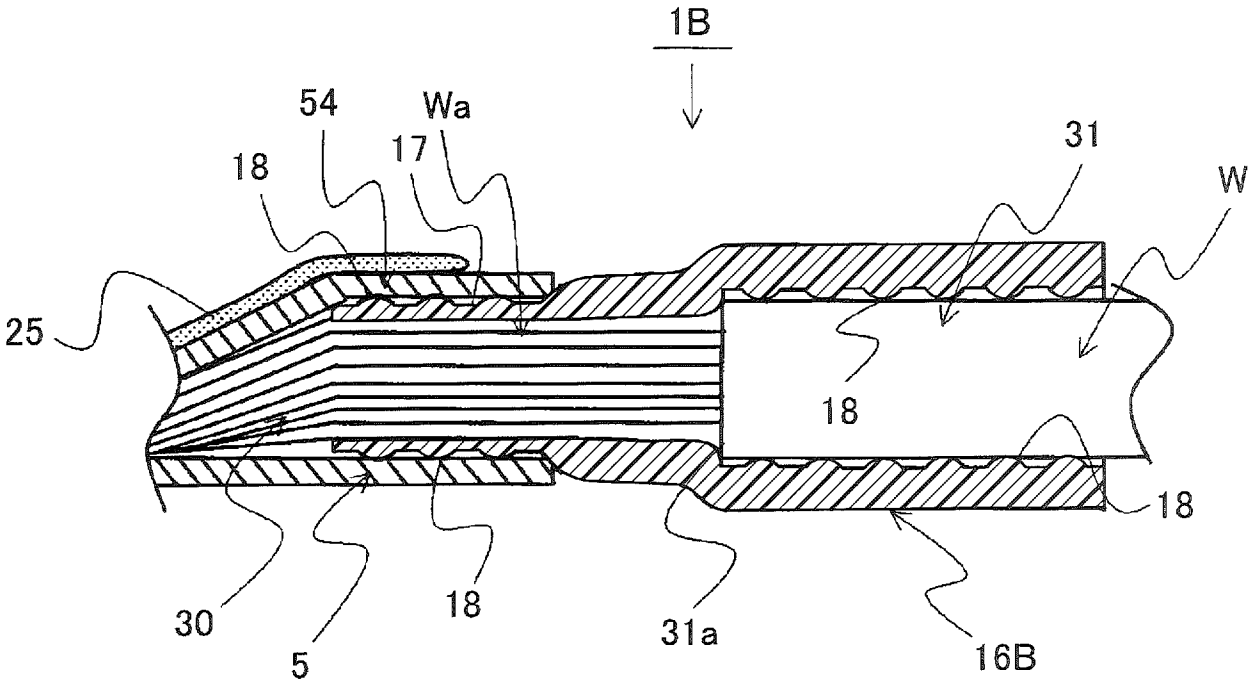
FIG. 14 is a cross sectional side view of the terminal crimped wire in which lip portions formed in an elastic member illustrated in FIG. 13 are further extended.

As illustrated in FIG. 14, the lip portions 18 may be further provided on the circumference of the elastic member 16B crimped by the elastic member crimping portion 54. Accordingly, it is possible to prevent water from entering the crimping terminal 5 more reliably.

Modified Example 2

Figure 15:
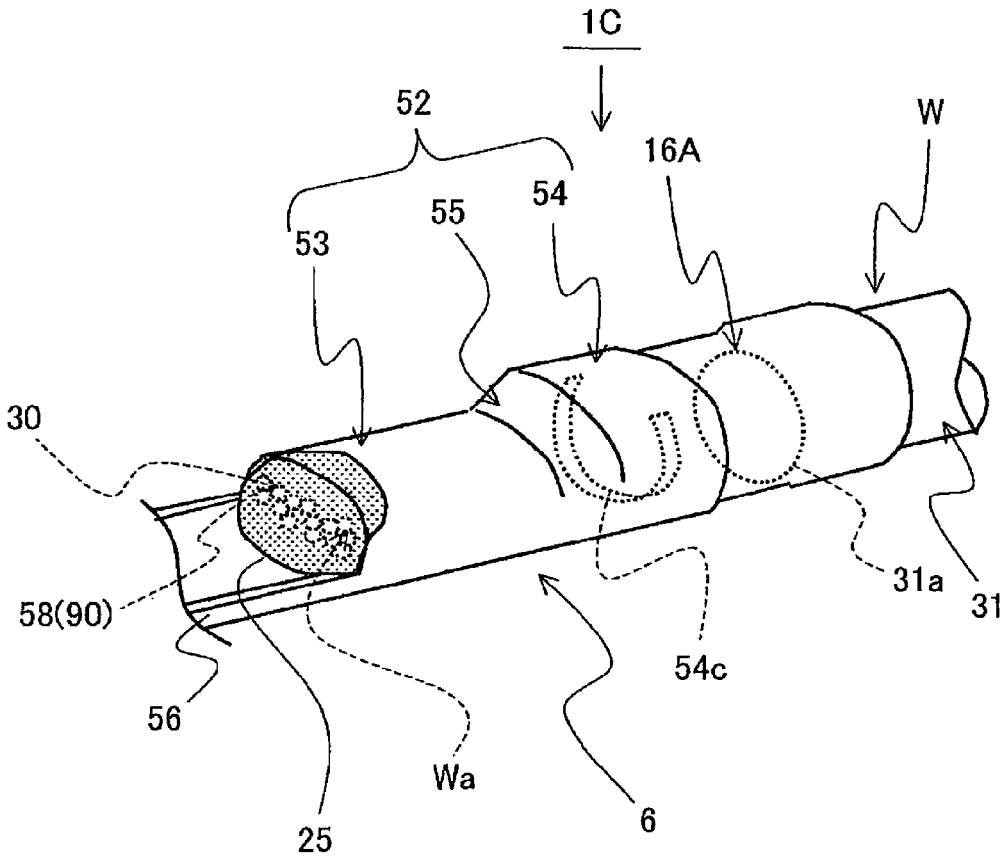
FIG. 15 is a perspective view of a main part of a terminal crimped wire according to a modified example 2 of the second embodiment.

A terminal crimped wire 1C according to a modified example 2 of the second embodiment is explained below with reference to FIG. 15.

The terminal crimped wire 1C according to the modified example 2 is different from the terminal crimped wire 1A according to the second embodiment in that a crimping terminal 6 is provided instead of the crimping terminal 5. Other components are the same as the second embodiment, and the same components are indicated by the same reference numerals as the second embodiment.

The crimping terminal 6 is a so-called closed barrel type crimping terminal. Therefore, the sealing material 25 is only applied to an opening 68 in the crimping terminal 6.

The terminal crimped wire 1C according to the modified example 2 can obtain the same effects as the terminal crimped wire 1A according to the second embodiment. In addition, since the exposed part of the conductor 30 drawn out of the crimping terminal 6 can be minimized, the water cut-off performance of the crimping terminal 6 can be further improved.

Modified Example 3

Figure 16:
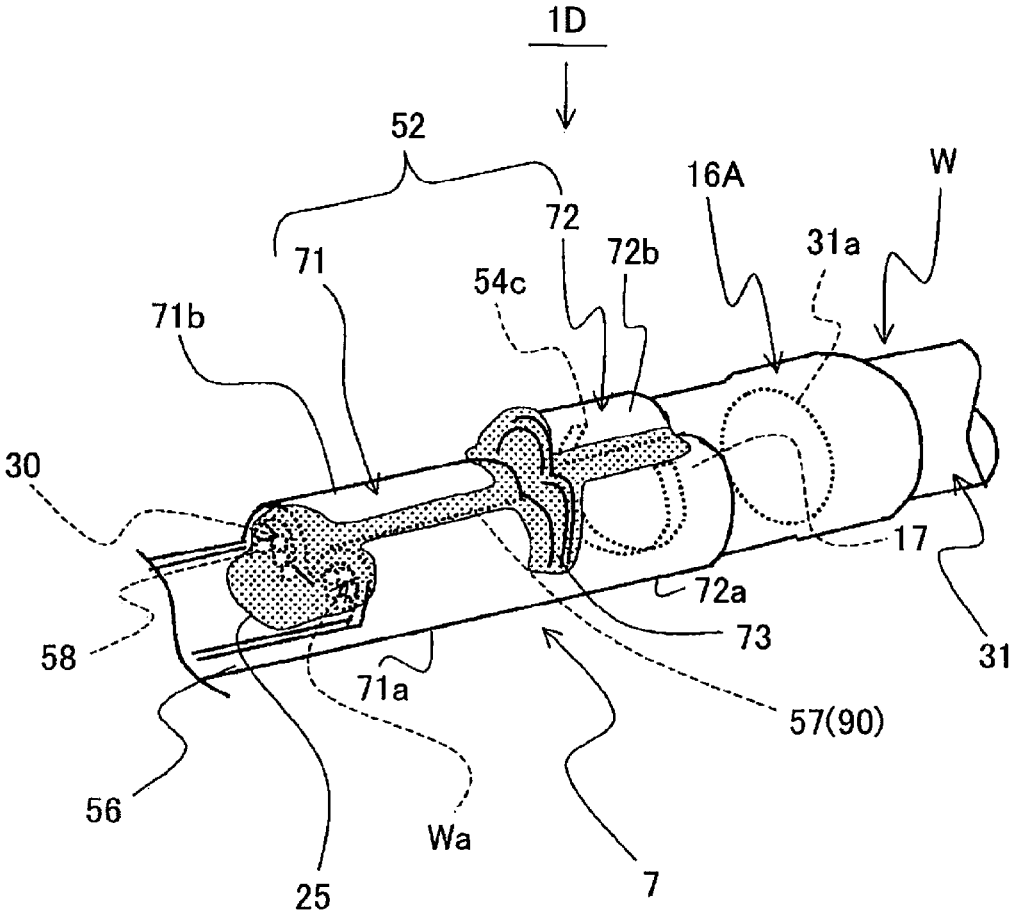
FIG. 16 is a perspective view of a main part of a terminal crimped wire according to a modified example 3 of the second embodiment.
Figure 17:
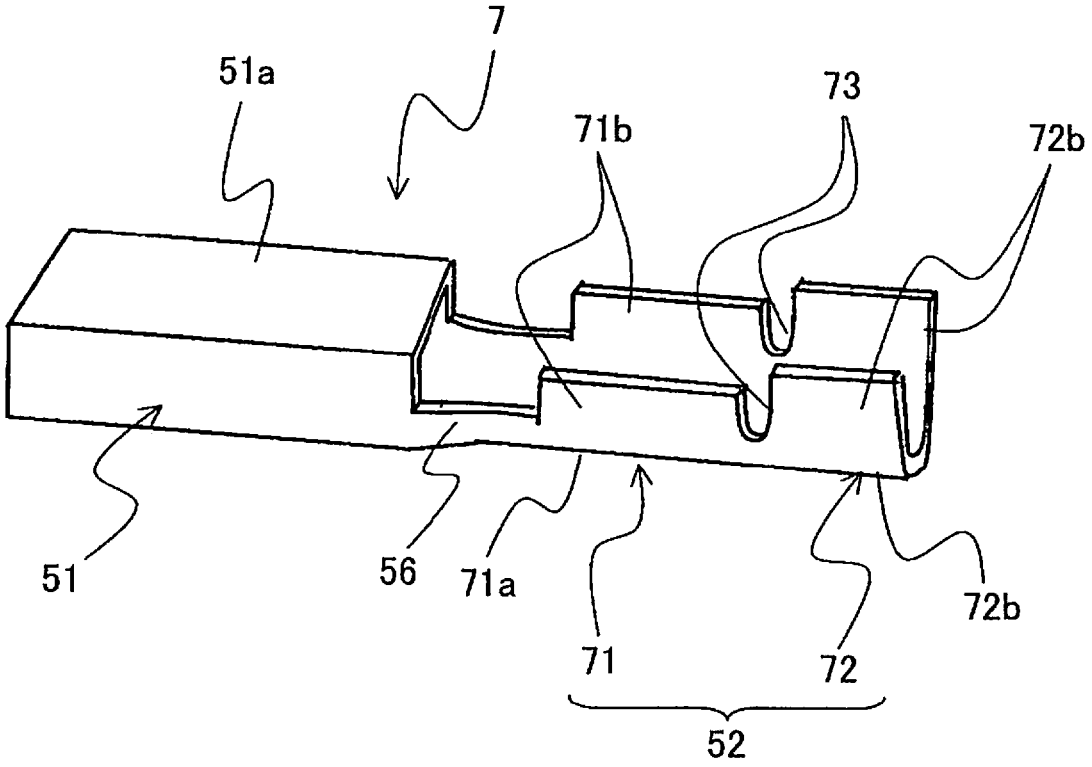
FIG. 17 is an enlarged perspective view of the crimping terminal illustrated in FIG. 16.

A terminal crimped wire 1D according to a modified example 3 of the second embodiment is explained below with reference to FIGS. 16 and 17.

The terminal crimped wire 1D according to the modified example 3 is different from the terminal crimped wire 1A according to the second embodiment in that a crimping terminal 7 is provided instead of the crimping terminal 5. Other components are the same as the second embodiment, and the same components are indicated by the same reference numerals as the second embodiment.

A pair of slits 73 is provided between a conductor crimping portion 71 and an elastic member crimping portion 72 of the crimping terminal 7, in a manner as to be elongated downward from each upper edge surface. With such configuration, the height of a pair of conductor crimping portion side walls 71*b* is set to be different from that of a pair of elastic member crimping portion side walls 72*b*. Namely, the crimping terminal 7 does not include the connection portion 55 of the terminal crimped wire 1A according to the second embodiment.

In the case of using the crimping terminal 7, the opening 73, which is the gap 90 provided by the pair of the slits 73 is sealed with the sealing material 25.

A conventional crimping terminal having a similar shape to the crimping terminal 7 may be used, in which the insulation sheath 31 is crimped by a portion corresponding to the elastic member crimping portion 72. In this case, the insulation sheath 31 is removed in a manner such that the exposed length of the conductor 30 at the terminal portion Wa of the wire W is set to be longer than that in a conventional wire crimped by the conventional crimping terminal, so that the insulation sheath 31 is not crimped by the crimping terminal 7.

The terminal crimped wire 1D according to the modified example 3 can obtain the same effects as the terminal crimped wire 1A according to the second embodiment.

Modified Example 4

Figure 18:
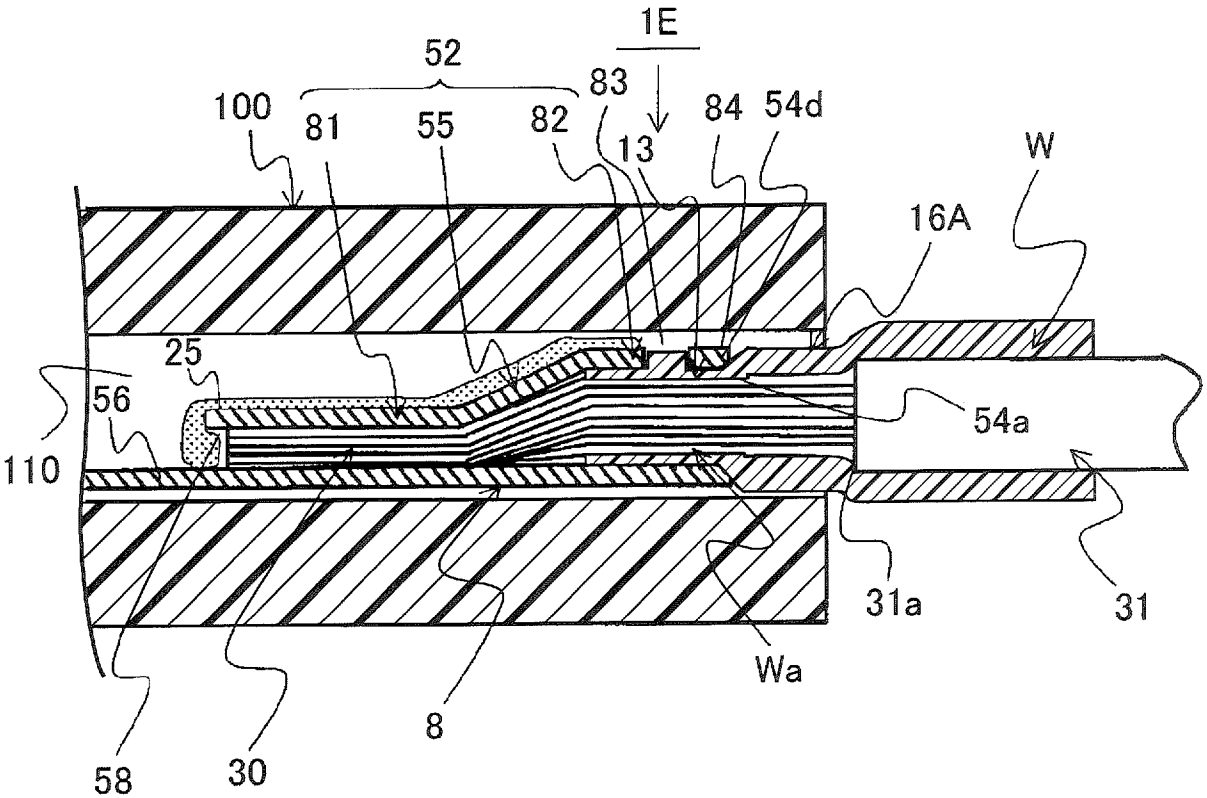
FIG. 18 is a cross sectional side view of a terminal crimped wire according to a modified example 4 of the second embodiment, and is a view to which a cross section of a connector housing equipped with the terminal crimped wire is added.
Figure 19:
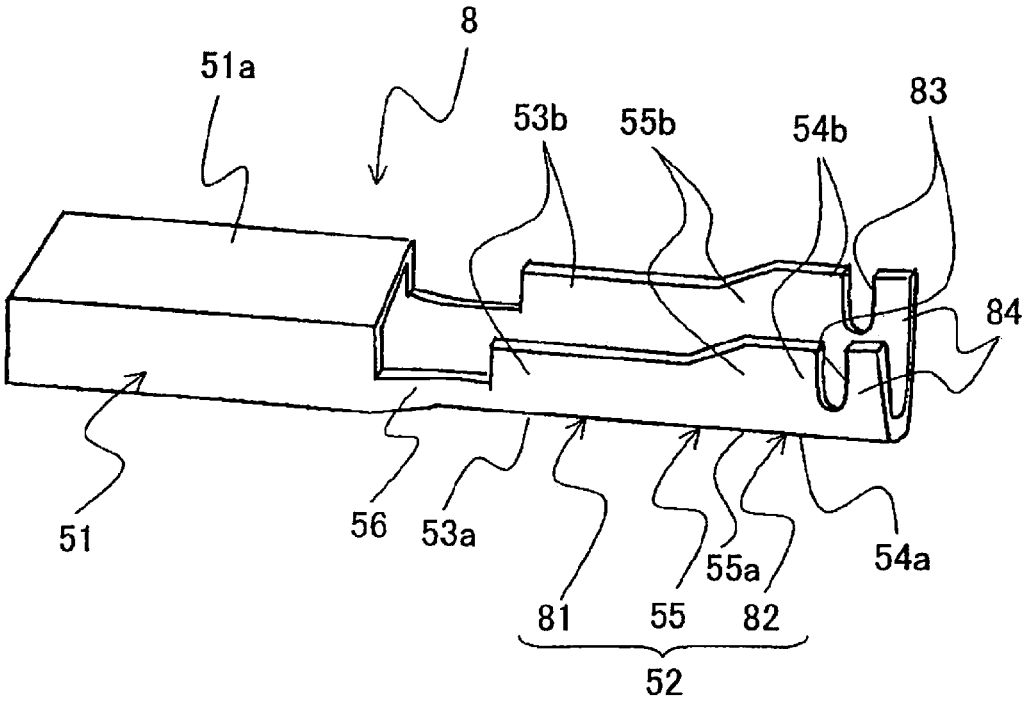
FIG. 19 is an enlarged perspective view of a crimping terminal illustrated in FIG. 18.

A terminal crimped wire 1E according to a modified example 4 of the second embodiment is explained below with reference to FIGS. 18 and 19.

The terminal crimped wire 1E according to the modified example 4 is different from the terminal crimped wire 1A according to the second embodiment in that a crimping terminal 8 is provided instead of the crimping terminal 5. Other components are the same as the second embodiment, and the same components are indicated by the same reference numerals as the second embodiment.

The crimping terminal 8 includes a pair of elastic member holding piece portions 84 to hold the elastic member 16A. Each elastic member holding piece portion 84 is provided with a slit 83 formed into a cantilever shape and elongated downward from each upper edge surface of an elastic member crimping portion 82.

The terminal crimped wire 1E according to the modified example 4 can obtain the same effects as the terminal crimped wire 1A according to the second embodiment.

The terminal crimped wire 1A according to the second embodiment was exemplified by the case in which the length of the part of the elastic member 16A where the exposed conductor 30 is covered, is set according to the dimension of the terminal housing portion 110 of the connector housing 100. However, the length of the part of the elastic member 16A where the exposed conductor 30 is covered, is not limited to this case, and may be set in a manner such that the part of the elastic member 16A covering the exposed conductor 30 is crimped by the elastic member crimping portions 54. This is because, in the case where the terminal crimped wire 1A including the insulation sheath 31 is housed in the terminal housing portion 110, an increase of the width in the diametrical direction of the insulation sheath 31 covered with the elastic member 16A can be prevented since the insulation sheath 31 is not crimped by the crimping terminal 5 in the terminal crimped wire 1A.

Thus, depending on the connector housing 100, the terminal crimped wire 1A including the part where the insulation sheath 31 is covered with the elastic member 16A, can be housed in the terminal housing portion 110.

Although the present invention has been described above by reference to the embodiments, the present invention is not limited to these embodiments, and various modifications and improvements can be made within the scope of the present invention.

What is claimed is:

1. A terminal crimped wire, comprising:

a wire including a conductor and an insulation sheath covering a circumference of the conductor;

a crimping terminal crimped to the wire;

an anticorrosion material which covers an exposed part of the wire drawn out of the crimping terminal; and an elastic member provided along a circumference of the wire, wherein the crimping terminal is crimped to the wire via the elastic member interposed therebetween, the conductor is made of aluminum or an aluminum alloy, the crimping terminal is crimped to the conductor exposed in a manner such that the insulation sheath at a terminal of the wire is removed, and to an end portion of the insulation sheath, the elastic member comprises a cylindrical elastic sealing member which covers a circumference of the end portion of the insulation sheath towards the exposed conductor and a circumference of the exposed conductor adjacent to the end portion of the insulation sheath, the crimping terminal comprises:

a conductor crimping portion crimping to the exposed conductor; and an elastic member crimping portion located in an end portion of the crimping terminal on a wire connection side to crimp a part of the elastic member where the circumference of the exposed conductor is covered, a gap in the crimping terminal crimped to the wire is covered with the anticorrosion material, a groove is provided on an inner surface of the elastic member crimping portion in a direction perpendicular to the extending direction of the wire, and an inner diameter of the elastic member is smaller than the diameter of the conductor such that the elastic member comes into close contact with the circumference of the insulation sheath and the circumference of the exposed conductor.

2. The terminal crimped wire according to claim 1, wherein serrations are provided on an inner surface of the crimping terminal.

3. The terminal crimped wire according to claim 1, wherein the crimping terminal comprises a pair of crimping pieces integrally crimped to the exposed conductor and the insulation sheath, the anticorrosion material is solder, and the solder covers an outer surface of the conductor drawn out of the crimping pieces and a gap between the crimping pieces.

4. The terminal crimped wire according to claim 3, wherein the part of the elastic member covering the circumference of the exposed conductor has a length in an extending direction of the wire which is set in a manner such that the part of the elastic member can fit in a terminal housing portion of a connector housing.

5. The terminal crimped wire according to claim 3, wherein lip portions are provided on and project from an inner surface of the elastic member in a corrugated pattern in cross section so as to decrease an inner diameter of the elastic member.

6. The terminal crimped wire according to claim 3, wherein the anticorrosion material is applied in a manner as to be distant from the insulation sheath in the extending direction of the wire.

7. The terminal crimped wire according to claim 3, wherein the elastic member crimping portion is integrated with the conductor crimping portion in the extending direction of the wire without interposing a gap therebetween.

8. The terminal crimped wire according to claim 1, wherein the cylindrical elastic sealing member of the elastic member comprises a cylindrical shape made of silicone rubber that is preliminarily fitted to the circumference of the insulation sheath before crimping.

9. The terminal crimped wire according to claim 1, wherein the elastic member fills a gap between the crimping terminal and the insulation sheath by a deformation in an elastic restoring direction.

10. The terminal crimped wire according to claim 1, wherein the anticorrosion material comprises solder, grease, or a hot-melt adhesive.

11. The terminal crimped wire according to claim 1, wherein the inner diameter of the elastic member is set smaller than the diameter of the insulation sheath by a heat-shrinkable elastic material.

12. The terminal crimped wire according to claim 1, wherein the elastic member crimping portion comprises an elastic member crimping portion bottom wall on which the cylindrical elastic sealing member is placed, and a pair of elastic member crimping portion side walls crimped in a manner as to cover the cylindrical elastic sealing member from both sides to the upper side of the cylindrical elastic sealing member.

13. The terminal crimped wire according to claim 12, wherein a height of the respective elastic member crimping portion side walls is set such that upper edge portions of the pair of the elastic member crimping portion side walls come into contact with each other so as to cover a circumference of the cylindrical elastic sealing member.

14. The terminal crimped wire according to claim 12, wherein:

a height of the respective elastic member crimping portion side walls is set according to a diameter of the cylindrical elastic sealing member;

the diameter of the cylindrical elastic sealing member is larger than that of the conductor by the thickness of the elastic member; and the height of the respective elastic member crimping portion side walls is set to be higher than that of the respective conductor crimping portion side walls.

15. The terminal crimped wire according to claim 1, wherein the cylindrical elastic sealing member comprises a crimp by the elastic member crimping portion such that a deformation level of the elastic member crimping portion at the point of crimping is smaller than that of the conductor crimping portion.

16. The terminal crimped wire according to claim 1, wherein the elastic member comprises a deformation to enter the groove at a point of crimping the cylindrical elastic sealing member by the elastic member crimping portion such that the groove prevents the wire from being removed from the crimping terminals by a tensile force in the extending direction of the wire.

17. The terminal crimped wire according to claim 1, wherein the inner surface of the elastic member crimping portion comprises a tapered surface inclined such that a thickness of the crimping terminal is decreased towards a rear edge surface thereof.

18. The terminal crimped wire according to claim 17, wherein the elastic member is deformed along the tapered surface, so that a gap between the crimping terminal and the conductor in the elastic member crimping portion on the rear edge surface side is sealed with the elastic member.

19. The terminal crimped wire according to claim 1, wherein a length of the cylindrical elastic sealing member in the extending direction of the wire is set such that the cylindrical elastic sealing member fit in a terminal housing portion of a connector housing in which the terminal crimped wire is housed.

* * * * *